United States Patent [19]

Okada

[11] Patent Number: 4,553,410

[45] Date of Patent: Nov. 19, 1985

[54] KNITTING NEEDLES WITH A FLEXIBLE CORD

[75] Inventor: Hidekazu Okada, Ashiya, Japan

[73] Assignee: Clover Mfg. Co., Ltd., Osaka, Japan

[21] Appl. No.: 527,424

[22] Filed: Aug. 29, 1983

[30] Foreign Application Priority Data

Aug. 30, 1982 [JP] Japan ..... 57-131060[U]
Jan. 11, 1983 [JP] Japan ..... 58-2534[U]

[51] Int. Cl.[4] ..... D04B 35/02
[52] U.S. Cl. ..... 66/117
[58] Field of Search ..... 66/116, 117, 118

[56] References Cited

U.S. PATENT DOCUMENTS 1,999,691 4/1935 Ghaham .
2,096,483 10/1937 Cook .
2,102,600 12/1937 Miller .
2,208,124 7/1940 Dunn ..... 66/117
2,309,528 1/1943 Otting et al. .
2,695,506 11/1954 Kohlmann ..... 66/117
4,341,094 7/1982 Heide ..... 66/117

FOREIGN PATENT DOCUMENTS 1585297 11/1969 Fed. Rep. of Germany ..... 66/117
2846329 5/1980 Fed. Rep. of Germany ..... 66/117

*Primary Examiner*—Ronald Feldbaum
*Attorney, Agent, or Firm*—Birch, Stewart, Kolasch & Birch

[57] ABSTRACT

A knitting needle with a flexible cord comprising at least one rigid needle body made of bamboo or wood whose rear end is formed with a limited length of axial bore into which a rigid tubular member is inserted and fastened there, a flexible cord having an integral axial extension which axially extends forwardly from an enlarged forward end wall of a substantially conical enlargement formed therewith, and both of a rear end wall of the tubular member and the annular terminal end wall of the needle body being in contact with the enlarged forward end wall of the enlargement.

9 Claims, 12 Drawing Figures

KNITTING NEEDLES WITH A FLEXIBLE CORD

BACKGROUND AND SUMMARY OF THE INVENTION

This invention relates to knitting needles with a flexible cord, and more particularly to improvement in the knitting needles of such particular type that has a flexible cord extended from the tapered rear end of an elongated, rigid needle shaft or body made of bamboo or wood.

As such particular type of knitting needles as having a flexible cord connected thereto, two typical models have heretofore been proposed; one being a circular type knitting needle which has a pair of metallic or plastic rigid needle bodies joined by a flexible middle cord, as illustrated in FIG. 1, and another being a non-circular type knitting needle which includes a single metallic or plastic rigid needle body and a flexible cord connected at its one end to the rear end of the needle body wherein a stich stop is slidably or fixedly mounted on a free end of the flexible cord in order to prevent stitches or loops of yarn from slipping off the flexible cord, as illustrated in FIG. 2.

In the described two types of knitting nedles with a flexible cord, it is necessary to provide means for connecting the flexible cord to a rear end of the rigid needle body. a typical conventional connecting means for that purpose is disclosed, for example, in U.S. Pat. No. 2,096,483 to Cook, in which a flexible cord is inserted into a cylindrical hollow space of a metallic needle body and fastened thereto by a suitable adhesive. Another conventional connecting means is disclosed, for example, in U.S. Pat. No. 1,999,691 to Graham, in which a flexible cord is provided with a threaded end section, which is screwed into an internally threaded bore formed in a rear end of a metallic needle body for connecting the flexible cord to the needle body by threads.

The flexible cord may be slidably or rotatably connected to a rear end of a needle body as disclosed, for example, in U.S. Pat. No. 2,309,528 to Otting et al and U.S. Pat. No. 2,102,600 to Miller.

Conventinally, the rigid needle body to which the flexible cord is connected is usually made of metal or rigid plastic material (not often), and the rear end section of the needle body shall be tapered to smoothly merge with the connecting end of the flexible cord. Naturally, the wall thickness of the rear terminal end of the needle body flexible cord is reduced to its possible minimum degree so as to provide smoothly continuous, flush external surfaces at the joints between the needle body and the flexible cord. In this connection, if a step or diametrical difference exists at the joints, a stitch or loop of yarn is prevented from freely passing over the joints, and as a result, desired efficient and comfortable knitting operation cannot be expected.

In addition to the above mentioned metallic or rigid plastic needle body, bamboo-made or wooden needle bodies have recently been proposed in the markets because of their good natural properties that they are pleasant to touch in use and permit a good relative sliding with respect to stiches or loops of yarn carried thereon. However, the proposed bamboo-made or wooden needle bodies have a fatal disadvantage in that they are fragile in nature and easily broken or damaged at the joints between the needle body and the flexible cord, more particularly, at the diametrically reduced and thin-walled marginal edge of the rear terminal end of the needle body in which the axial bore for insertion of the flexible cord end is formed to provide an opening mouth.

Further, none of the methods for connecting the flexible cord with the rear end of the needle body as disclosed in the above discussed U.S. Pat. Nos. 1,999,691, 2,309,528 and 2,102,600 are applicable to the bamboo-made or wooden needle bodies.

It is, therefore, an object of the present invention to substantially reduce the above-discussed problems inherent to bamboo-made or wooden knitting needles with a flexible cord.

Another object of the invention is to improve durability of a bamboo-made or wooden knitting needles with a flexible cord and to put them to practical use by making the best use of excellent natural properties inherent to bamboo or wood.

A further object of the invention is to provide an improved knitting needle with a flexible cord, in which a bamboo-made or wooden needle body is diametrically reduced at its rear end to merge with the flexible cord without inviting a problem of easy damage or breakage at the joints between the needle body and the flexible cord.

A still further object of the invention is to provide an improved knitting needle with a flexible cord, in which means is provided for preventing local concentration of bending strains to the joints between the needle body and the flexible cord during operation.

Other objects, features and advantages of the present invention will become apparent from the detailed description given hereinafter; it should be understood, however, that the detailed description and specific examples, while indicating preferred embodiments of the invention, are given by way of illustration only, since various changes and modifications wihin the spirit and scope of the invention will become obvious to those skilled in the art from this detailed description.

According to the present invention, there is provided a knitting needle with a flexible cord which includes at least one rigid needle body made of bamboo or wood whose rear end is formed with an axial bore therein and diametrically reduced to be thin-walled, a flexible cord having an integral axial extension which extends axially forwardly from a conical enlargement formed therewith, and a rigid tubular member disposed within the axial bore formed in the needle body end for receiving the axial extension of the flexible cord therein when they are connected together.

DESCRIPTION OF THE PREFERRED EMBODIMENTS

Figure 1:
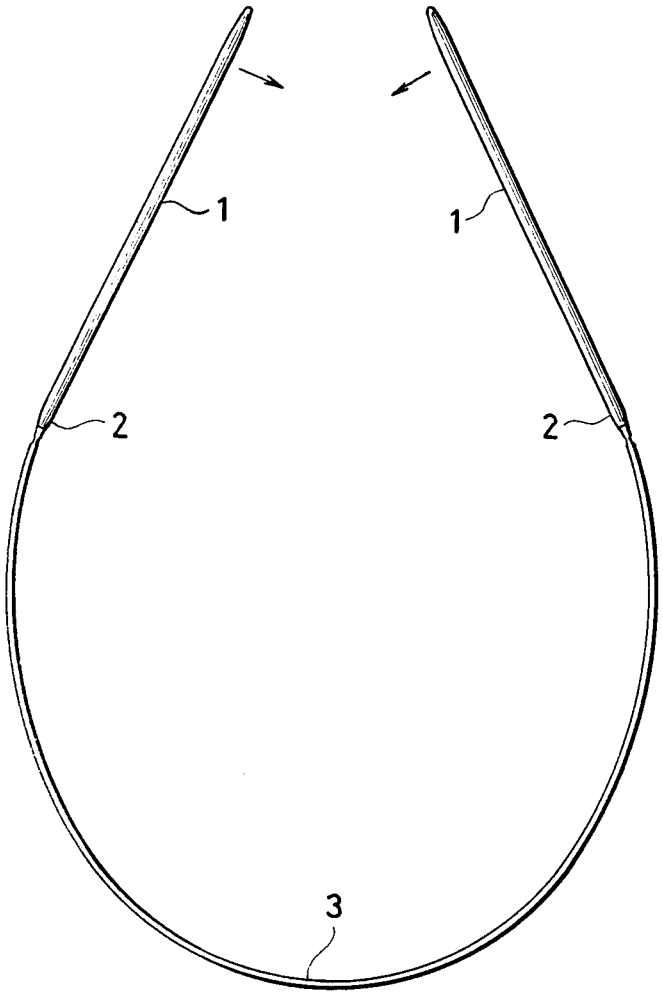
FIG. 1 is a perspective view of a circular type knitting needle with a flexible cord.
Figure 2:
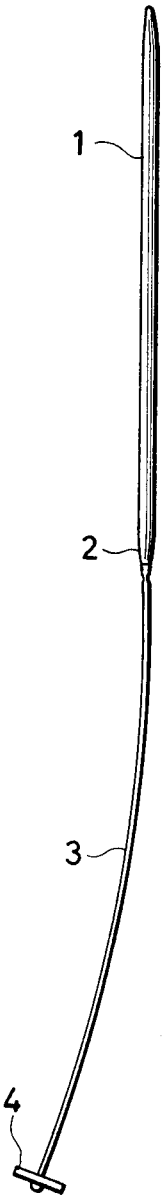
FIG. 2 is a perspective view of a non-circular type knitting needle with a flexible cord.

Referring now to the accompanying drawings, wherein identical reference numerals are used throughout various views to designate not only identical but also substantially like or corresponding parts or elements, FIG. 1 illustrates a circular type knitting needle having a pair of rigid needle bodies 1 joined at their rear ends 2 by a middle flexible cord 3, while FIG. 2 illustrates a non-circular type knitting needle which includes a needle body 1 and a flexible cord 3 connected at the rear end 2 of the needle body and having a known stitch stop 4 mounted on the free end of the flexible cord. The present invention is applicable to any of these two types of knitting needles with a flexible cord.

According to the present invention, each of the needle bodies 1 is made of bamboo or wood. In the illustrated embodiments, each of the needle bodies 1 is of a straight bar-shaped in configuration, however, it may be formed at its forward end with a hook (not shown) so as to provide a known crochet hook as disclosed in U.S. Pat. No. 2,102,600 referred to in the foregoing.

Figure 5A:
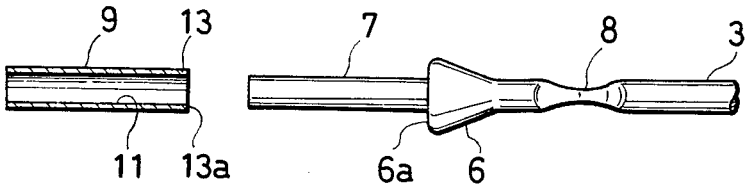
FIGS. 5A to 5C are elevational views, partly in section, showing a series of steps for connecting the flexible cord to the rigid needle body according to the invention.
Figure 5B:
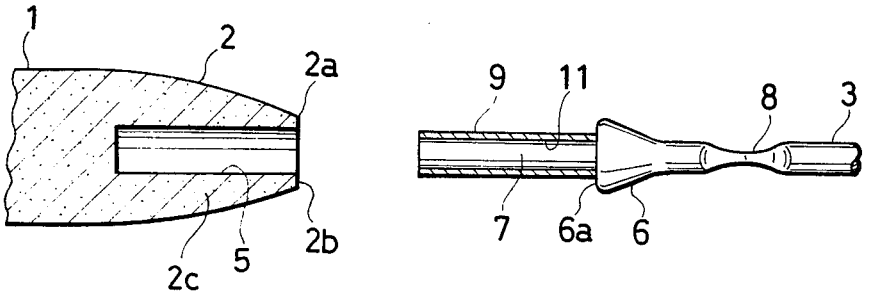

The tapered rear end section 2 of the needle body 1, preferably in the center thereof, is formed with an axial bore 5 which extends axially from the rear terminal end 2*a* into the needle body in a limited range slightly beyond an axial length of the tapered section 2, as best shown in FIG. 5B.

The rear end section 2 is tapered or gradually reduced in diameter, so that the thickenss of the cylindrical wall 2*c* of the needle body is minimized at the terminal end 2*a*, conventionally.

The flexible cord 3, round in cross section, may preferably be formed of thermoplastic synthetic resin of flexible nature such as nylon.

Each of the connecting ends of the flexible cord 3, at which it is connected to the rear end 2 of the needle body 1, is formed with an enlargement 6, preferably conical in shape. The enlargement 6 has an annular flange-shaped end wall 6*a* at its enlarged forward end whose external diameter is substantially equal to that of the reduced rear terminal end 2*a* of the needle body 1 in order to avoid undesirable diametrical difference therebetween for the purpose of permitting free passing of stitches over the joints between the needle body and the flexible cord when they are connected together. The enlagement may be formed, for example, by heating the connecting end of the flexible cord to cause deformation as illustrated.

Each of the connecting ends is formed with a limited length of axial extension 7 which extends forwardly from the enlagement 6. The extension 7 is of such external diameter as can be inserted into a rigid tubular member 9 to be hereinafter described in detail.

The flexible cord 3 may peferably be partially deformed for example into a substantially flat shape at a position near the rear of the enlargement 6 to provide a relatively easily bendable portion 8, so that the bending strains imparted to the joints between the needle body and the flexible cord can be advantageously dispersed and absorbed by this portion 8. Provision of the portion 8 also permits easy manipulation of a pair of needle bodies 1 in the inward directions as indicated by the arrows in FIG. 1. The easily bendable portion may be formed by merely diametrically reducing a limited part of the flexible cord 3 at the position adjacent the enlargement 6.

The rigid tubular member 9, made of metal or rigid synthetic resin, is disposed within the axial bore 5 so as to be interposed between the cylindrical wall 2*c* of the rear end section 2 of the needle body 1 and the inserted axial extension 7 of the flexible cord 3. The phrase "tubular member" herein used includes various forms of tubular elements which are limited in length, rigid and not easily bendable, and have an axially extending mounting bore 11 whose internal diameter is predetermined so as to correspond with the external diameter of the axial extension 7 of the flexible cord thereby to permit snug insertion of the latter into the former.

Figure 3A:
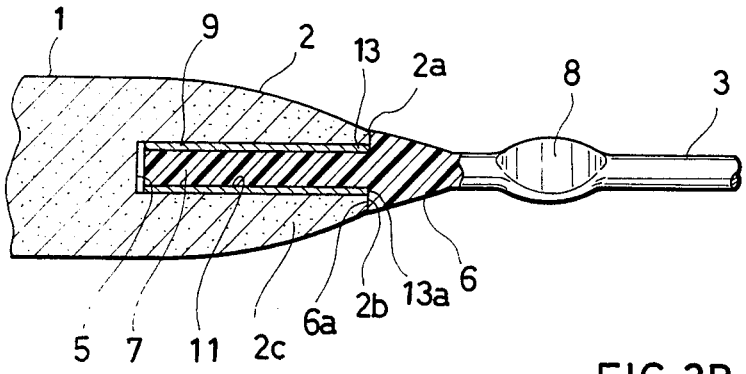
FIG. 3A is an enlarged, fragmentary perspective view, partly in section, showing the joined regions of the rigid needle body and the flexible cord according to the present invention.

For example, the tubular member 9 may be in the form of a hollow tube or pipe having the axial bore 11 extending through the entire length of the tube, as shown in FIGS. 3A and 5A.

Figure 3B:
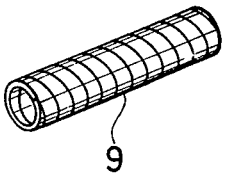
FIG. 3B is a perspective view showing a modification of a tubular member.
Figure 4A:
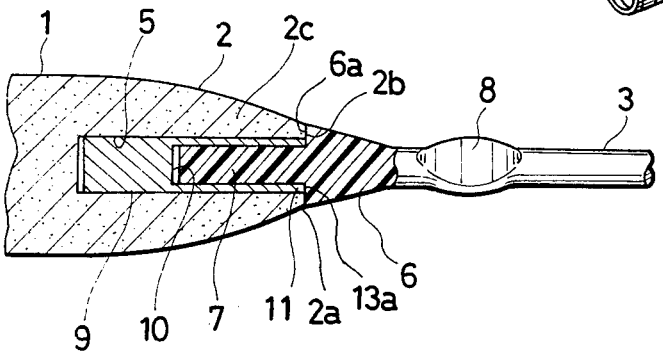
FIG. 4A is a similar view to FIG. 3A, but showing another embodiment of the joined regions of the rigid needle body and the flexible cord according to the invention.
Figure 6A:
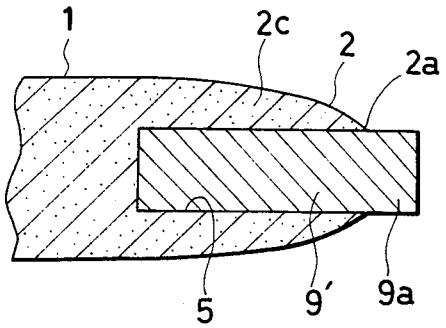
FIGS. 6A to 6C are similar views to FIGS. 5A to 5C, showing modification of a series of steps for connecting the flexible cord to the rigid needle body according to the invention.
Figure 6B:
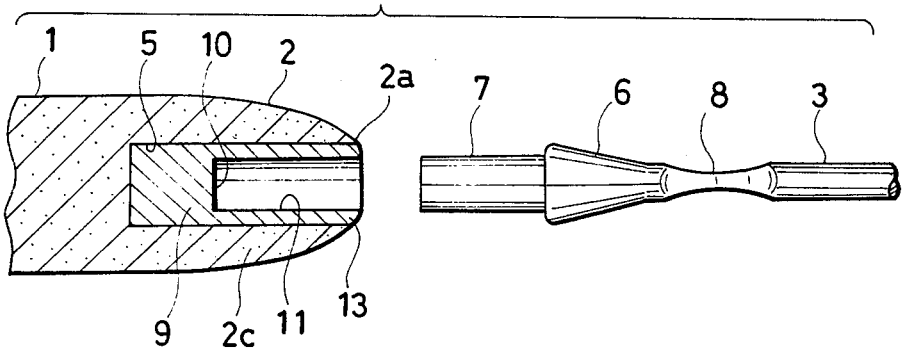
Figure 6C:
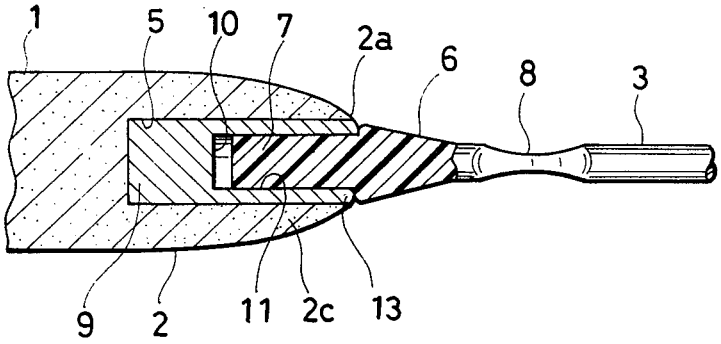

The tubular member 9 may be a tightly coiled spring of a hollow cylindrical form as particularly shown in FIG. 3B, or may be a partly hollow cylindrical element having an internal end wall 10 at the inner end of the bore 11 as shown in FIGS. 4A, 6B, 6C. The tubular member 9 may be formed of a solid bar material 9′ by drilling the axial bore 11 therein after it has been inserted into the axial bore 5 and then fastened thereto, as illustrated in FIGS. 6A and 6B.

In the embodiment as shown FIGS. 3A and 5A to 5C, the tubular member 9 is illustrated as being equal in axial length to the axial extension 7 of the flexible cord 3. However, the extension 7 may be somewhat smaller in axial length than the tubular member 9. In case where the axial bore 5 is larger in axial length than the tubular member 9, the extension 7 may slightly project at its forward end out of the tubular member 9.

While, in the embodiment as shown in FIGS. 4A and 6C, the axial length of the extension 7 shall be slightly smaller than that of the mounting bore 11 in order to permit full insertion, so that the annular end wall 6*a* can be in tight abutment with the annular rear end wall 2*b* to provide smoothly continuous joints therebetween when the flexible cord 3 is connected to the needle body 1.

Figure 4B:
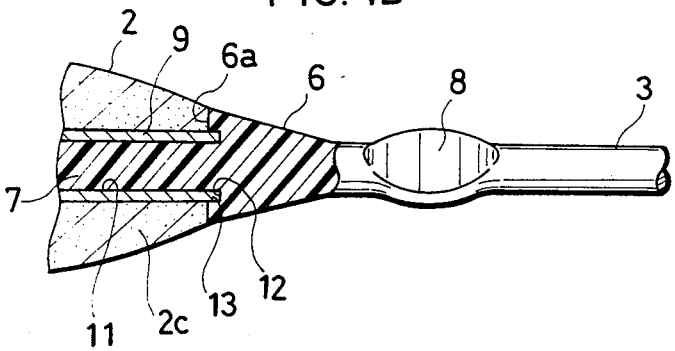
FIG. 4B is an enlarged longitudinal section showing a further modified embodiment of the joined region of the rigid needle body and the flexible cord according to the invention.

In the particular embodiment as shown in FIG. 4B, in which a cylindrical groove 12, coaxial with the extension 7 and the tubular member 9, is formed in the forward end wall 6*a* of the enlargement 6, so that the rear end section 9*a* can be snugly received therein, the axial length of the tubular member 9 may be larger than that of the axial bore 5 substantially by the axial length of the cylindrical groove 12.

It should be noted, however, that the rear end wall 13*a* (FIG. 5A) of the tubular member 9 is substantially flush with the annular rear end wall 2*b* of the needle body 1, or alternatively, disposed slightly out of the bore 11, through out the embodiments.

Figure 5C:
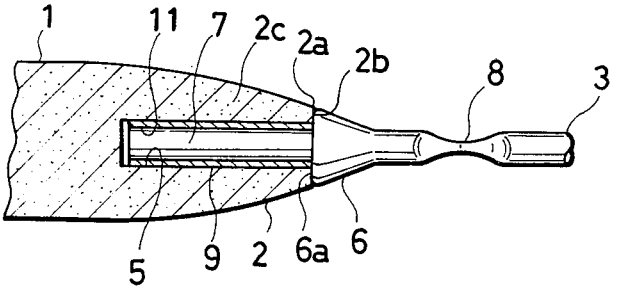

In one example of assembly, the tubular member 9 may be inserted over the axial extension 7 as shown in FIGS. 5A and 5B and fastened there by means of a suitable adhesive or otherwise, by radially pressing the tubular member 9 at its proper region onto the extension 7 for firmly holding the same. Then, as shown in FIG. 5C, the extension 7 together with the tubular member 9 mounted thereon is inserted into the axial bore 5 until the flange-shaped annular end wall 6*a* of the enlargement 6 comes into contact with the annular rear end wall 2*b* of the needle body 1 and fastened there by means of a suitable adhesive.

In another example of assembly, the tubular member 9 may be inserted into the axial bore 5 and fastened there by a suitable adhesive, and then, the extension 7 is inserted into the mounting bore 11 and fastened there by a suitable adhesive, as illustrated in FIGS. 6B and 6C.

In the particular case as illustrated in FIG. 6A where a solid bar material 9′ is utilized to form the tubular member 9 thereof, the bar material 9′ may be inserted into the axial bore 5 and fastened there by a suitable adhesive, and then the mounting bore 11 is formed therein by drilling. In case where one end 9*a* of the bar material 9′ projects out of the bore 5 illustrated in FIG. 6A, the projecting end 9*a* may preferably be cut off together with a part of the rear end section 2 of the needle body and then finished at the same time to provide smoothly continuous and flush end surfaces. Finally, the extension 7 is inserted into the drilled mounting bore 11 and fastened there by adhesive.

The knitting needles according to the invention are of such specific construction as described in the foregoing, wherein the rigid tubular member 9 is interposed between the cylindrical wall 2*c* of the needle body 1 and the inserted axial extension 7 of the flexible cord 3. Thus, the rear end section 2 of the needle body, which is made of bamboo or wood, is prevented from being damaged or broken at its thin-walled terminal rear end 2*a* by bending strains repeatedly imparted thereto during knitting operation, because the terminal end 2*a* is properly reinforced by the rigid end 13 of the tubular member 9 and at the same time the bending strains are prevented from being concentrated to the weakest terminal end 2*a* owing to the rigidity of the tubular member.

The present invention being thus described, it will be obvious that same may be varied in many ways. Such variations are not to be regarded as a departure from the spirit and scope of the invention, and all such modifications as would be obvious to one skilled in the art are intended to be included within the scope of the following claims.

I claim:

1. A knitting needle with a flexible cord, comprising at least one rigid needle body made of bamboo, said needle body having a tapered rear end section with an annular rear terminal end wall surrounding an opening mouth of an axial bore formed in said tapered rear end section, said axial bore extending forwardly from said terminal rear end wall into said needle body within a limited range slightly beyond an axial length of said tapered rear end section;

a rigid tubular member disposed within and fastened to said axial bore of said needle body; and a flexible cord having an integral axial extension which axially extends forwardly from an enlarged forward end wall of a substantially conical enlargment formed integrally with the flexible cord, and is inserted into and fastened to a mounting bore of said rigid tubular member, wherein a rear end wall of said tubular member is in contact with said enlarged forward end wall of said enlargment and said annular rear terminal end wall of the needle body is in contact with said enlarged forward end wall of said enlargement to thereby form a smooth continuous joint between said tapered rear end section of said needle body and said substantially conical enlargment of said flexible cord.

2. The knitting needle, as defined in claim 1, wherein said tubular member is a hollow tube having a mounting bore extending through an entire axial length of said tube.

3. The knitting needle, as defined in claim 1, wherein said tubular member is a partly hollow cylindrical element having an internal end wall at an inner end of said mounting bore of the tubular member.

4. The knitting needle, as defined in claim 1, wherein said tubular member is a coiled spring of cylindrical form.

5. The knitting needle, as defined in claim 1, wherein said tubular member is fixedly mounted on said axial extension of the flexible cord and then inserted together with said axial extension into said axial bore of the needle body and fastened there by adhesive.

6. The knitting needle, as defined in claim 1, wherein said tubular member is inserted into and fastened to said axial bore of the needle body and then said axial extension of the flexible cord is inserted into said mounting bore of the tubular member and fastened there.

7. The knitting needle, as defined in claim 6, wherein said tubular member is formed of a solid bar material by drilling said mounting bore therein after said bar material has been inserted into and fastened to said axial bore of the needle body.

8. The knitting needle, as defined in claim 1, wherein a cylindrical groove is formed in said enlarged forward end wall of said enlargement, said groove being coaxial with said tubular member for receiving a rear end of said tubular member therein.

9. A knitting needle with a flexible cord, comprising:

at least one rigid needle body made of bamboo, said needle body having a tapered rear end section with an annular rear terminal end wall surrounding an opening mouth of a straight axial bore formed in said tapered rear end section, said axial bore extending forwardly from said terminal rear end wall into said needle body within a limited range only slightly beyond the axial length of said tapered rear end section;

a rigid tubular reinforcing member disposed within and fastened to said axial bore of said needle body, said rigid tubular member having a tubular internal mounting bore and a rear end wall, said tubular member being formed of a solid bar material by drilling said mounting bore therein after said bar material has been inserted into and fastened to said axial bore of said needle body, said rear end wall of said tubular member extending slightly out of said axial bore of said needle body; and a flexible cord having an integral axial extension which axially extends forwardly from an enlarged forward end wall of a stubstantially conical enlargement formed integrally with the flexible cord inserted into and fastened to said mounting bore of said rigid tubular member, said rear end wall of said tubular member being in contact with said enlarged forward end wall of said enlargement and said rear end wall of said tubular member being in close proximity to said enlarged forward end wall of said enlargement to thereby form a smooth continuous joint between said tapered rear end section of said needle body and said substantially conical enlargement of said flexible cord.

* * * * *